United States Patent [19]

Kojima et al.

[11] Patent Number: 4,676,191

[45] Date of Patent: Jun. 30, 1987

[54] DEVELOPMENT DEVICE

[75] Inventors: Tetsuji Kojima; Mikio Yamamoto, both of Tokyo, Japan

[73] Assignee: Oki Electric Industry Co., Ltd., Tokyo, Japan

[21] Appl. No.: 798,680

[22] Filed: Nov. 15, 1985

[30] Foreign Application Priority Data

Nov. 16, 1984 [JP] Japan ..... 59-240446

[51] Int. Cl.[4] ..... G03G 15/09

[52] U.S. Cl. ..... 118/657; 355/3 DD

[58] Field of Search ..... 118/657, 658; 355/3 DD

[56] References Cited

U.S. PATENT DOCUMENTS 4,244,322 1/1981 Nomura et al. ..... 118/657 X

*Primary Examiner*—Bernard D. Pianalto

[57] ABSTRACT

A development device has a developer tank for housing a developer, a development roll disposed within the developer tank on one end portion thereof, a magnetic roll included in the development roll via a sleeve for attracting the developer onto the circumferential surface of the sleeve, a photosensitive drum disposed facing to the development tank keeping a finely prescribed distance thereto for carrying an electrostatic latent image thereon, and a magnetic member disposed in the vicinity of an opening for development in the development tank axially of the development roll for allowing lines of magnetic force from the magnetic roll to pass therethrough thereby preventing the developer on the photosensitive drum from being substantially affected by a magnetic field from the magnet roll.

7 Claims, 8 Drawing Figures

DEVELOPMENT DEVICE

BACKGROUND OF THE INVENTION

Field of the Invention

The present invention relates to a development device used in an electrophotographic recording system with use of magnetic toner.

Prior dry-type development devices are disclosed in U.S. Pat. Nos. 4,267,248, 4,297,970, and 4,309,498. Describing these development devices with reference to FIG. 2, an electrostatic latent image carrier 1 (hereinafter referred to as a photosensitive drum) has a development roll 2 provided in a confronting relation thereto. The development roll 2 comprises a nonmagnetic cylindrical sleeve 3 and a magnet roll 4 having a plurality of magnetic poles which axially extend and have polarities alternately different from each other in the circumferential direction. The magnet roll 4 is provided in the sleeve 3, and both are relatively rotatable. A developer tank 5 is provided around the development roll 2, and a development region P formed between the photosensitive drum 1 and the development roll 2 both arranged in a confronting relation keeping a slight space therebetween.

In such a development device, a magnetic toner developer 6 is attracted onto the circumferential surface of the sleeve 3 by magnetic force of the magnet roll 4 in the developer tank 5. The sleeve 3 and the magnet roll 4 are rotated in the direction of the arrows A and B respectively at different speeds of revolutions, whereby toner chains are formed around the development roll 2 and carried from an outlet 7 provided on one end of the development roll 2 located upward of the circumference thereof to the development region P.

In the development region P, the toner chains are frictionally brought into contact with the electrostatic latent image formed on the photosensitive drum 1 in rotation in the direction of the arrow E, whereby part of the developer 6 electrostatically adheres onto the photosensitive drum 1, carried to a transfer region (not shown), and transferred onto a paper sheet. By contrast, remaining developer 6 which does not adhere onto the photosensitive drum 1 is again retrieved from an inlet 8 provided on the other end of downward the development roll 2 downward the circumference thereof. Here, broken lines shown in FIG. 2 schematically show lines of magnetic force formed by the magnet roll 4.

However, in such prior development devices, part of the developer adhered onto the photosensitive drum due to electrostatic force is subjected to larger magnetic force than the attraction force due to the above electrostatic force by a moving magnetic field produced by the rotation of the magnet roll prior to the transfer of the latent image onto the paper sheet. As a result, this part of the developer is moved onto the photosensitive drum or falls off downward of the photosensitive drum and drops on a printing paper sheet carried to the transfer region. The former deteriorates the picture quality formed on the printing surface while the latter brings about background stains on the printing surface. Namely, both exert bad influences upon the picture quality.

For resolving these problems, a method is provided wherein the developer tank is formed with a magnetic substance and thereby the moving magnetic field does not exert a magnetic influence upon the photosensitive drum. However, this causes scattering of the developer.

The scattering phenomenon will be described with reference to FIGS. 3(*a*), 3(*b*) and 3(*c*). The figures are schematics illustrating relations between the lines of magnetic force in the vicinity of the development roll and the developer. Therefore, the same numbers shall be applied to the same portions as the prior examples, omitting the description therefor.

First, as shown in FIG. 3(*a*), the magnetic flux density is concentrated on an edge part 9*a* of the magnetic developer tank 9 due to the magnetic force from the magnet roll 4, so that the developer on the development roll 2 is captured near the concentrated region. The top end of the captured developer 6 located on the side of the development roll 2 is magnetized to an N magnetic pole in the vicinity of the edge part 9*a* of the developer tank 9, while the other end of the developer 6 on the developer tank edge part is magnetized to an S magnetic pole, as shown in FIG. 3(*a*).

Given a state shown in FIG. 3(*b*) due to rotation of the magnet roll 4 in the direction of the arrow B, the top end of the developer 6 is moved in the direction of the arrow R by movement of the lines of magnetic force due to positional movements of the N and S poles. In addition, when the N and S poles reach positions shown in FIG. 3(*c*) due to the rotation of the magnet roll 4, a polarity of the edge 9*a* of the developer tank 9 is changed to the same S magnetic pole as the polarity of the top end of the developer 6 located on the side of the developer tank 9. Therefore, the developer 6 is scattered in the arrow T direction as shown in FIG. 3(*c*).

Further, in FIGS. 3(*a*), 3(*b*), 3(*c*), even if the N and S poles are assumed to be reversed, the same situation as that shown in FIGS. 3(*a*), 3(*b*), and 3(*c*) is produced and the developer 6 is likewise scattered. Accordingly, the magnetic roll 4 is continuously rotated, whereby part of the developer 6 carried on the development roll 2 is continuously scattered. As a result, a problem is produced in which a surface of a printing sheet (not shown) is stained with the developer 6, and thereby the printing quality is sharply deteriorated.

SUMMARY OF THE INVENTION

In view of the drawbacks with the conventional development device, it is an object of the present invention to provide an improved development device wherein a developer carried on a photosensitive drum is prevented from being moved on and falling off the photosensitive drum due to the movement of the magnet roll, whereby the printing quality on a printing paper sheet is improved.

To achieve the above object, a development device according to the present invention has a magnetic developer tank for housing a developer, a development roll disposed within the developer tank on one end thereof, a magnet roll disposed in a cylindrical sleeve to form the development roll, a photosensitive drum placed outside the developer tank facing toward the developer roll while keeping a fine space between the development roll and the photosensitive drum, the above developer tank having an opening therethrough disposed in a confronting relation to the photosensitive drum, the photosensitive drum allowing toner chains to be held and moved on the circumferential surface of the development roll and be adapted to frictionally slide on the circumferential surface of the photosensitive drum due to magnetic force from the magnet roll and relative rotation between the magnet roll and the sleeve, and a magnetic member disposed in the axial direction of the development roll in the vicinity of the opening in the developer tank for allowing the lines of magnetic force from the magnet roll to pass therethrough and thereby preventing the developer on the photosensitive drum to be substantially not affected by the magnetic field from the magnet roll.

The above and other objects, features and advantages of the present invention will become more apparent from the following description when taken in conjunction with the accompanying drawings in which preferred embodiments of the present invention are shown by way of illustrative examples.

DESCRIPTION OF THE PREFERRED EMBODIMENT

Figure 1:
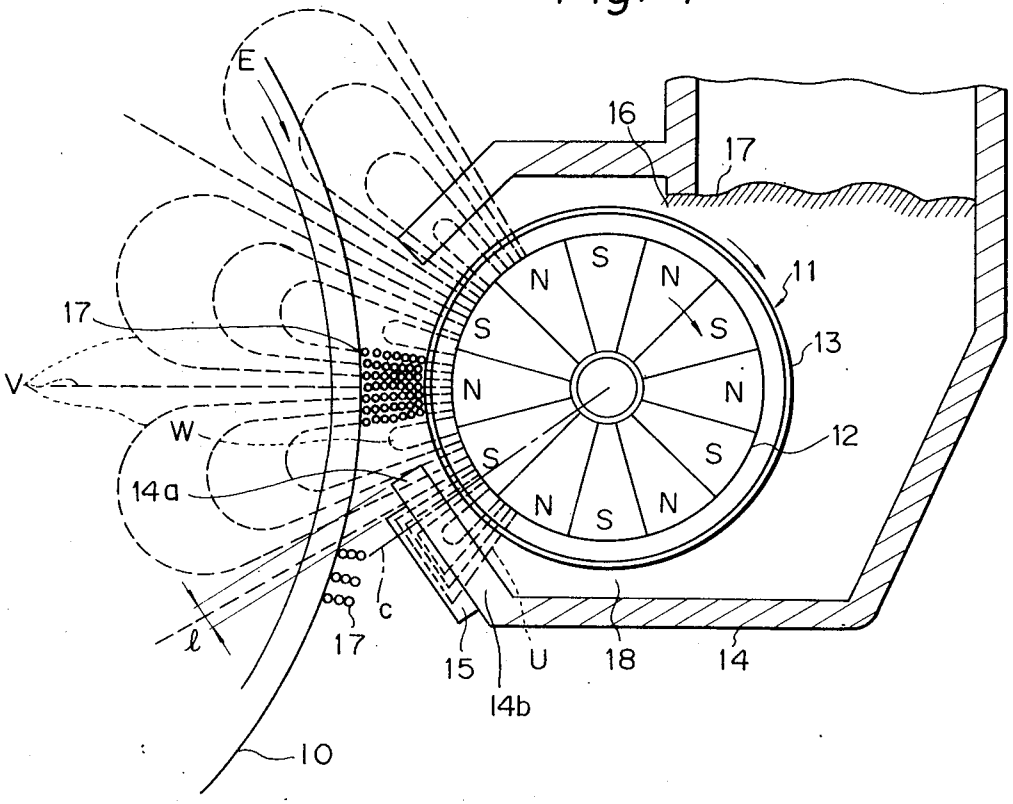
FIG. 1 is a sectional view illustrating a portion of a first embodiment of a dry development device in the vicinity of a development roll according to the present invention.

A first embodiments of a development device according to the present invention will be described with reference to FIG. 1.

Designated at 10 is a photosensitive drum typically formed by a photosensitive material such as selecium, and adapted to rotate at a prescribed speed of revolution in the direction of arrow E. The numeral 11 denotes a development roll disposed in a confronting relation to the photosensitive drum 10 while keeping a minute interval between the photosensitive drum 10 and the development roll 11. The development roll includes a magnet roll 12 having a plurality of magnetic poles extending axially thereof and being alternately different in their polarities from each other in the circumferential direction thereof, and a non-magnetic cylindrical sleeve 13. In addition, the magnet roll 12 is located in the sleeve 13 such that they are relatively rotatable about an axis extending parallel to the axis of rotation of the drum 10. In the present embodiment, the magnet roll 12 includes 12 permanent magnets disposed therein, which present 600 G of surface magnetic flux density as a whole. Further, the outer diameter of the sleeve 13 is 37 mm, and that of the photosensitive drum 80 mm.

Figure 3A:
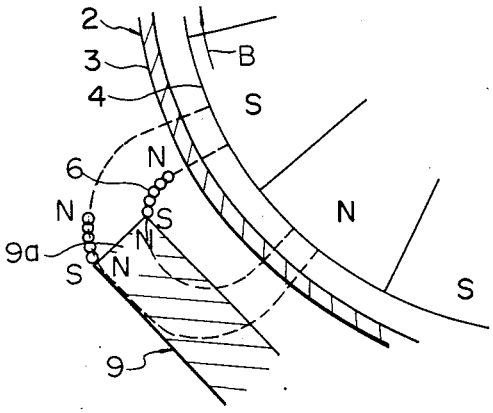
Fig. 3a PRIOR ART
FIGS 3(*a*), 3(*b*), and 3(*c*) are respectively sectional views illustrating a portion of another prior development device in which state transitions of lines of magnetic force and a developer in the vicinity of a development roll are shown.
Figure 3B:
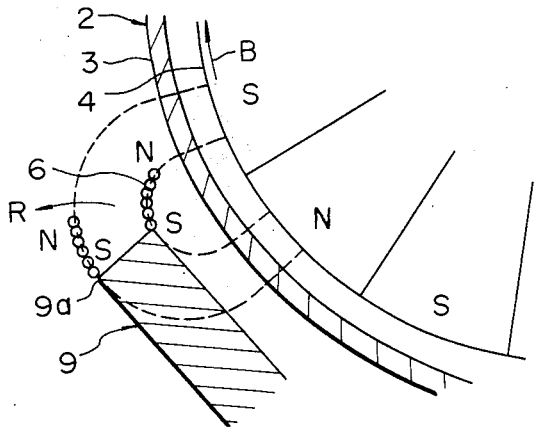
Fig. 3b PRIOR ART
Figure 3C:
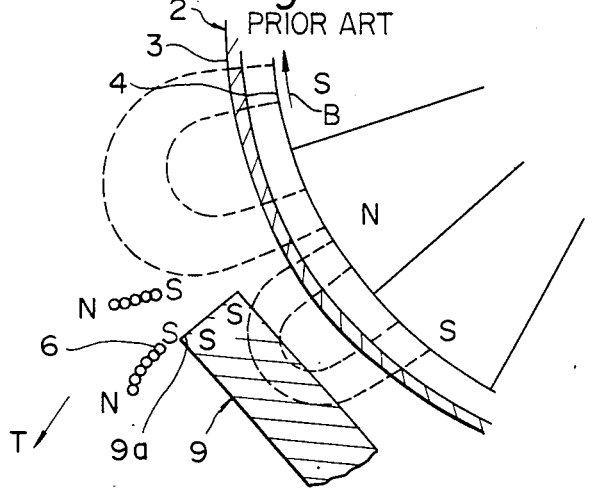
Fig. 3c PRIOR ART
Figure 5A:
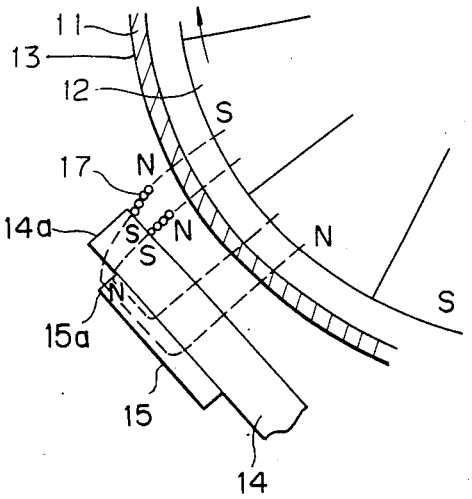
FIGS 5(*a*), and 5(*b*) are sectional views illustrating the portion of FIG. 1.
Figure 5B:
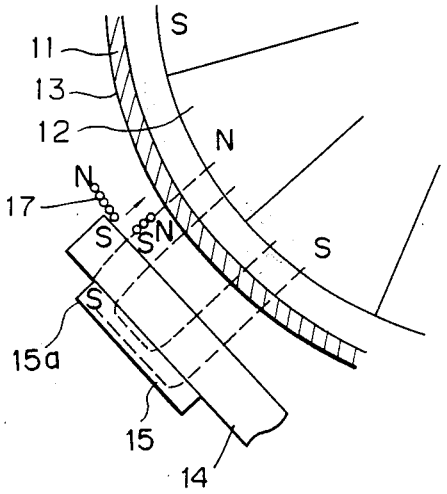

Designated at 14 is a non-magnetic development tank which includes the development roll 11 housed therein on the lower end region thereof and through which an opening is formed in a development region W between the development roll 11 and the photosensitive drum 10. Designated at 15 is a plate-shaped magnetic member disposed on the lower outer wall 14*b* adjacent, but entirely spaced from a distance 1 from, an opening 14*a* of the developer tank 14 present in the vicinity of the photosensitive drum 10 over the entire length of the development roll 11 in the axial direction of the development roll 11. As shown in FIGS. 1, 5(*a*) and 5(*b*), the lower outer wall or wall portion 14*b* opposes the sleeve 11 and therefore extends substantially perpendicularly to a radial line C extending from the axis of the roll 11 through the sleeve 13 and wall portion 14*b*, that is substantially parallel to a tangent to the portion of the roll 11 opposed by the wall portion 14*b*. Thus, also as shown in FIGS. 1, 5(*a*) and 5(*b*), the magnetic member 15 also extends in a direction parallel to the tangent to the portion of the roll 11 opposed by the wall portion 14*b*. the invention differs from the prior art as shown in FIGS. 3(*a*), 3(*b*), and 3(*c*) illustrating operation of the prior development device in that, the plate-shaped magnetic member 15 is disposed below the opening 14*a* of the developer tank 14 on the opposite side of the magnet roll 12 spaced by a prescribed interval 1 from the opening 14*a*, and thereby even if the magnet roll 12 is rotated, no change of lines of magnetic force is caused which pass through the lower side of the opening 14*a* and have an influence on the toner carried on the photosensitive drum. In the present embodiment, the magnetic substance 15 is adapted to have a thickness of 0.5 mm, a width of 10 mm, and the prescribed distance l being $0<l<10$ mm, ideally from 1 mm to 5 mm, and thereby lines of magnetic force V near the magnetic substance 15 are given as shown in FIG. 1.

Designated at 16 is an outlet which is formed by the surface of the sleeve 13 of the development roll 11 and an inner wall of the developer tank 14. A developer 17 is supplied from a fine space formed axially of the development roll 11 through the outlet 16 to the peripheral surface of the development roll 11. Designated at 18 is an inlet which is formed by the surface of the sleeve 13 of the development roll 11 and the inner wall of the development tank 14. The developer 17 is replenished from a supply port (not shown) of the developer tank 14, which is opened only upon replenishing the developer 17 and usually closed. Accordingly, the developer 17 contained in the developer tank 14 is allowed to pass through the outlet 16, and reduced by a fraction thereof used for development. Broken lines V shows lines of magnetic force.

Operation of the development device of the present embodiment will be described. The developer 17 comprising magnetic toner is attracted on the peripheral surface of the sleeve 13 in the developer tank 14 by magnetic force of the magnet roll 12. The sleeve 13 and the magnet roll 12 are rotated in the direction of the arrows A and B respectively at different speed, and thereby a layer of developer chains, i.e., toner chains having a prescribed thickness are formed on the peripheral surface of the development roll 11 and carried from the outlet 16 to the development region W.

In the development region W, the toner chains are brought into frictional contact with the electrostatic latent image on the photosensitive drum 10 in rotation in the direction of the arrow E, whereby part of the developer 17 is allowed to adhere onto the photosensitive drum 10 by electrostatic force, carried to a transfer region (not shown), and transferred onto a paper sheet. By contrast, remaining developer 17 not adhered onto the photosensitive drum 10 is again retrieved into the developer tank 14.

Figure 2:
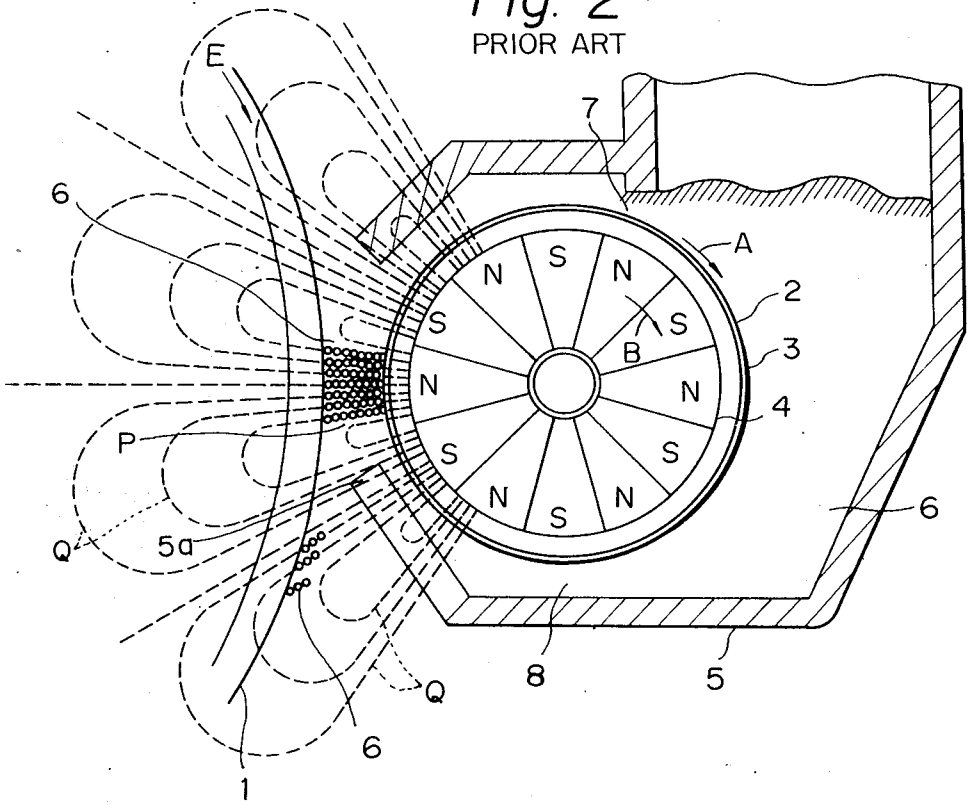
Fig. 2 PRIOR ART
FIG. 2 is a sectional view illustrating a portion of a prior development device in the vicinity of a development roll.

Here, the developer 17 on the photosensitive drum 10 is moved to the transfer region by rotation of the photosensitive drum 10. However, the developer is affected in a prior development device in an interval from the development region P to the transfer region by moving magnetic force of the magnet roll 4, as shown in FIGS. 2 and 3(*a*), 3(*b*), and 3(*c*), and moved onto the photosensitive drum 1 to deteriorate the image quality on the printed surface and scattered to stain the printed surface of the sheet, whereby a printing quality is remarkably lowered.

Against this, in the present invention, lines of magnetic force in the vicinity of the magnetic member 15 is distributed as the broken lines U shown in FIG. 1. This has no effect on the developer 17 on the photosensitive drum 10. Therefore, the developer 17 is not moved onto the photosensitive drum 10 or allowed to fall therefrom.

Describing this with reference to FIG. 5, a partial enlarged view of FIG. 1, magnetic flux density is concentrated at the edge part 15*a* of the magnetic member 15 due to the magnetic force of the magnet roll 12 of FIG. 5(*a*). However, since the above edge part 15*a* is isolated from the developer 17 by the non-magnetic developer tank 14, the developer 17 is attracted to a position shown. When the magnet roll 12 is rotated to the position as shown in FIG. 5(*b*) and thereby a polarity of the edge part 15*a* of the magnetic member 15 is reversed, the developer 17 is scattered in the direction of the development roll 11, and captured on the surface of the development roll 11 by the magnetic force of the magnet roll 12. Thus, the developer is not scattered to the outside of the magnetic tank 14.

A second embodiment of a dry development device according to the present invention will be described with reference to FIG. 4. The same numbers and symbols in FIG. 4 represent the same portion as the first embodiment.

In the first embodiment the magnetic member 15 is disposed on the lower outer wall of the one end of the developer tank 14 axially of the development roll 11, while in the second embodiment the magnetic substance 15 is buried in the lower inner part of an opening 19*a* of a developer tank 19. Namely, the magnetic member 15 is buried in the lower inner part of the opening 19*a* of the developer tank 19 spaced a prescribed distance l from the opening 19*a* substantially over the entire length of the development roll 11 axially thereof.

Figure 4:
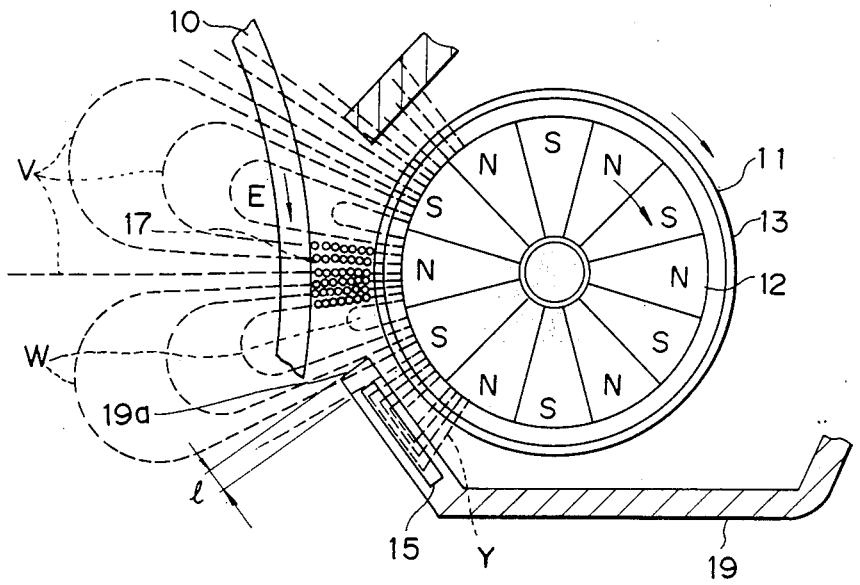
FIG. 4 is a sectional view of a dry development device according to a second embodiment of the present invention in the vicinity of a development roll.

In the present second embodiment, lines of magnetic force in the vicinity of the magnetic member 15 are distributed as shown by broken lines Y shown in FIG. 4, and exert the same effect as in the first embodiment. Namely, a magnetic field has little effect on the developer on the photosensitive drum 10. Further, the developer 17 is captured to the lower end of the opening 19*a* in the developer tank 19 without scattering.

In addition, in the above first and second embodiments, the material quality and size of the magnetic member 15, the prescribed distance l, and the number of poles of the magnet roll 12 are limited. But, the present invention is generally not limited to them. For example, a magnet roll 12 having the 14 or 16 poles may be employed.

According to the present invention, the magnetic member is disposed axially of the development roll in the vicinity of the opening part for development in the developer tank. Accordingly, the lines of magnetic of the magnet roll passes through the magnetic member, and thereby the magnetic field has little effect on the developer on the photosensitive drum. Therefore, it can be avoided that the developer on the photosensitive drum is moved on the photosensitive drum to permit an image quality on the printed surface to be disturbed, and further the developer on the photosensitive drum falls to stain the printed surface of a printing paper sheet, whereby a printing quality is deteriorated. Moreover, it can be eliminated that the developer is captured to the lower end of the opening part in the developer tank and scattered. Consequently in accordance with the invention, the printed sheet surface is not stained, and thus the printing quality is not deteriorated.

Thus, conventional problems can be prevented from being produced, whereby the printing quality can be improved.

Although certain preferred embodiments have been shown and described, it should be understood that many changes and modifications may be made therein without departing from the scope of the appended claims.

What is claimed is:

1. A development device, comprising a development roll having a first axis of rotation, including a cylindrical magnet roll rotatable about said first axis of rotation, having a cylindrical peripheral surface and including a plurality of north and south poles alternately disposed about said first axis of rotation at the circumference of said magnet roll, and a nonmagnetic cylindrical sleeve enclosing the cylindrical peripheral surface of said magnet roll, said magnet roll and said sleeve being simultaneously rotatable about said first axis of rotation at different rotational speeds;

a developer tank for holding a quantity of developer comprising magnetic toner, said development roll being disposed in said developer tank, said developer tank having on opening therein extending axially of said development roll and located in the vicinity of said sleeve;

a photosensitive drum having a second axis of rotation extending parallel to said first axis of rotation, said drum having a cylindrical peripheral surface opposing said sleeve across said opening, said drum being rotatable in a prescribed rotational direction about said second axis of rotation and being electrostatically attractive of magnetic toner on said sleeve across said opening; and a magnetic member, said tank having spaced apart first and second wall portions having respective first and second opposite edges defining said opening therebetween, said second wall portion directly opposing a portion of said development roll and extending in a direction substantially parallel to a tangent to said portion of said development roll, said first and second wall portions being disposed such that points on the cylindrical peripheral surface of said drum successively pass said first wall portion, said opening and said second wall portion in the named order during rotation of said drum in said prescribed rotational direction, said magnetic member being fixed to said second wall portion, located with respect to said second wall portion entirely spaced from said second edge in a circumferential direction of said development roll away from said opening in said tank, and shaped and oriented so as to extend in directions parallel to said second axis of rotation and substantially parallel to said tangent to said portion of said development roll, thereby to prevent particles of said magnetic toner magnetically attracted toward said second edge and said magnetic member from being scattered onto said drum as said magnet roll rotates.

2. A development device as in claim 1, wherein said magnetic member is spaced from said second direction in the circumferential direction of said development roll by a distance l, $0<l<10$ mm.

3. A development device as in claim 2, wherein 1 mm$<l<$5 mm.

4. A development device as in claim 3, wherein said development device has a width measured in said circumferential direction of 10 mm and a thickness of 0.5 mm.

5. A development device as in claim 4, wherein sleeve has an outer diameter of 37 mm and said drum has an outer diameter of 80 mm.

6. A development device as in claim 1, wherein said magnetic member is mounted on an outer surface of said tank at said second wall portion.

7. A development device as in claim 1, wherein said magnetic member is buried in said second wall portion.

* * * * *